US009869977B2

(12) United States Patent
Hasegawa

(10) Patent No.: US 9,869,977 B2
(45) Date of Patent: Jan. 16, 2018

(54) RADIO-CONTROLLED TIMEPIECE

(71) Applicant: CASIO COMPUTER CO., LTD., Hamura-shi (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/596,104

(22) Filed: Jan. 13, 2015

(65) Prior Publication Data

US 2015/0198928 A1 Jul. 16, 2015

(30) Foreign Application Priority Data

Jan. 14, 2014 (JP) ..... 2014-004043

(51) Int. Cl.
*G04R 20/02* (2013.01)
*G04R 20/04* (2013.01)

(52) U.S. Cl.
CPC ..... *G04R 20/04* (2013.01)

(58) Field of Classification Search
CPC ..... G04R 20/00; G04R 20/02
See application file for complete search history.

(56) References Cited

U.S. PATENT DOCUMENTS

2006/0176777 A1* 8/2006 Ihara ..... G04R 20/10 368/47
2008/0165628 A1* 7/2008 Urano ..... G04C 9/02 368/47
2010/0240968 A1* 9/2010 Zeindler ..... A61B 5/0002 600/301
2012/0243383 A1* 9/2012 Honda ..... G04R 20/04 368/47
2012/0286995 A1* 11/2012 Elwell, Jr. ..... G04R 20/02 342/357.62

(Continued)

FOREIGN PATENT DOCUMENTS

JP 2000-171576 6/2000
JP 2001-051077 2/2001
JP 2002-071854 3/2002

(Continued)

*Primary Examiner* — Amy Cohen Johnson
*Assistant Examiner* — Jason Collins
(74) *Attorney, Agent, or Firm* — Cozen O'Connor

(57) ABSTRACT

A radio-controlled timepiece is shown including the following. A timekeeping unit keeps date and time. A date/time obtaining unit obtains date/time information from outside to correct the date and time of the timekeeping unit. A preliminary notice information obtaining unit obtains from outside preliminary notice information regarding whether leap second adjustment in which a leap second is inserted or deleted is executed. A date/time obtaining necessity setting unit sets whether the date/time information needs to be obtained based on history of obtaining the date/time information. The date/time obtaining necessity setting unit sets that the date/time information needs to be obtained when the preliminary notice information is not obtained by the adjustment possible date/time or the leap second adjustment is executed at the adjustment possible date/time, and does not change setting when the preliminary notice information is obtained and the leap second adjustment is not executed.

6 Claims, 8 Drawing Sheets

(56) References Cited

U.S. PATENT DOCUMENTS

| | | | | |
|---|---|---|---|---|
| 2013/0051186 | A1* | 2/2013 | Honda | G04R 20/04 368/47 |
| 2013/0121118 | A1* | 5/2013 | Eliezer | G04G 7/02 368/47 |

FOREIGN PATENT DOCUMENTS

| | | |
|---|---|---|
| JP | 3796380 | 4/2006 |
| JP | 2008-145287 | 6/2008 |
| JP | 2009-250801 | 10/2009 |
| JP | 2011-208946 | 10/2011 |
| JP | 2012-150061 | 8/2012 |
| JP | 2012-202875 | 10/2012 |
| JP | 5114936 | 10/2012 |
| JP | 5200636 | 2/2013 |

* cited by examiner

RADIO-CONTROLLED TIMEPIECE

BACKGROUND OF THE INVENTION

Field of the Invention

The present invention relates to a radio-controlled timepiece.

Description of the Related Art

Conventionally, there has been an electronic timepiece (radio-controlled timepiece) which is able to obtain date/time data from an external date/time information source to correct date and time kept by a timekeeping circuit. Examples of such external date/time information source include, a transmitting radio wave from a navigation satellite (positioning satellite) used in a Global Navigation Satellite System (GNSS, positioning system), a transmitting radio wave of a standard radio wave transmitting station which transmits time information with a radio wave having a long waveband, date/time information output from a wired or wireless server (NTP server) on the Internet, date/time information obtained by a cellular phone from a base station of the cellular phone and received from the cellular phone by short distance wireless communication, and the like. Such external date/time information source each have their advantages and disadvantages regarding accuracy, easiness of reception, time necessary for reception, electric power consumed in reception, and the like. Therefore, conventionally, there is an electronic timepiece which uses a plurality of methods to obtain date/time information in order to support the disadvantages (for example, Japanese Patent No. 3796380, Japanese Patent Application Laid-Open Publication No. 2002-71854).

Such radio-controlled timepiece obtains the date/time information from outside at a suitable recurrence so that normally, the error can be maintained at a very small degree. However, a leap second may be inserted or deleted from the date and time employed worldwide at present. The timing that insert or delete of the leap second can be executed is set at directly before 00:00:00 on January 1st or July 1st in Coordinated Universal Time (UTC). The insert or delete of the leap second is executed as necessary based on the time of the UTC and difference in culmination time due to rotation of the Earth, and the time is shortened or lengthened for 1 second.

Such delete or insert of the leap second is performed irregularly, and is not always executed each time. Therefore, timepieces which do not obtain information regarding the insert or delete of the leap second in advance cannot judge whether there is a delete or insert of the leap second. Therefore, after the insert or delete is executed, the time is counted and displayed with a difference in the amount of 1 second.

The date and time (GPS timepiece) counted in each GPS satellite and transmitted in the radio wave transmitted from the positioning satellite (GPS satellite) of the Global Positioning System (GPS) does not consider the above described insert and delete of the leap second. Various correction parameters for the date/time data are transmitted from the GPS satellite. Information regarding the added value of the leap second executed from a predetermined timing (Jan. 6, 1980) is included in the correction parameters. Therefore, the new added value needs to be obtained after the insert or delete of the leap second is executed, otherwise the correct present date and time cannot be calculated from the date/time data of the GPS timepiece.

However, the data of the UTC correction parameter including the correction parameter regarding the leap second is transmitted only once every 12.5 minutes in the transmitting radio wave from the GPS satellite. When a portable radio-controlled timepiece, specifically, a timepiece which uses a small battery such as a watch is used, it is difficult to receive satellite radio waves for a long period of time because a large amount of electric power needs to be consumed compared to the electric power consumed for other various operation in the timepiece. In view of the above, according to the technique disclosed in Japanese Patent No. 5114936 and Japanese Patent No. 5200636, after the information regarding the date and time is obtained, the interval of time until the transmitting timing of the UTC correction parameter is calculated, and after the reception is paused, the reception is performed again at the transmitting timing of the UTC correction parameter to suppress the electric power consumption.

According to the technique disclosed in Japanese Patent Application Laid-Open Publication No. 2011-208946, after the timing that the leap second can be executed, a notification that the displayed date and time may not be accurate is displayed until an accurate date and time is obtained from outside.

However, since the insert or delete of the leap second is not always executed, receiving the date/time data each time after the above timing regardless of whether the insert or delete of the leap second is executed and confirming the leap second results in increase of electric power consumption.

SUMMARY OF THE INVENTION

The present invention has been conceived in view of the above problems, and one of the main objects is to provide a radio-controlled timepiece which is able to keep accurate date and time data suitably confirming whether the insert or delete of the leap second is executed while suppressing increase of power consumption.

According to an aspect of the present invention, there is provided a radio-controlled timepiece including:

a timekeeping unit which keeps date and time;

a date/time obtaining unit which obtains date/time information from outside to correct the date and time of the timekeeping unit;

a preliminary notice information obtaining unit which obtains from outside preliminary notice information regarding whether leap second adjustment in which a leap second is inserted or deleted is executed; and a date/time obtaining necessity setting unit which sets whether the date/time information needs to be obtained by the date/time obtaining unit based on history of obtaining the date/time information by the date/time obtaining unit, wherein the date/time obtaining necessity setting unit, (i) sets that the date/time information needs to be obtained at a timing of adjustment possible date/time which is determined to be date and time when the leap second adjustment can be executed, when the preliminary notice information is not obtained by the adjustment possible date/time or the leap second adjustment is executed at the adjustment possible date/time; and (ii) does not change setting at the adjustment possible date/time when the preliminary notice information is obtained and the leap second adjustment is not executed.

BRIEF DESCRIPTION OF THE DRAWINGS

The present invention and the above-described objects, features and advantages thereof will become more fully understood from the following detailed description with the accompanying drawings and wherein.

DESCRIPTION OF THE PREFERRED EMBODIMENTS

An embodiment of the present invention is described with reference to the drawings.

First Embodiment

Figure 1:
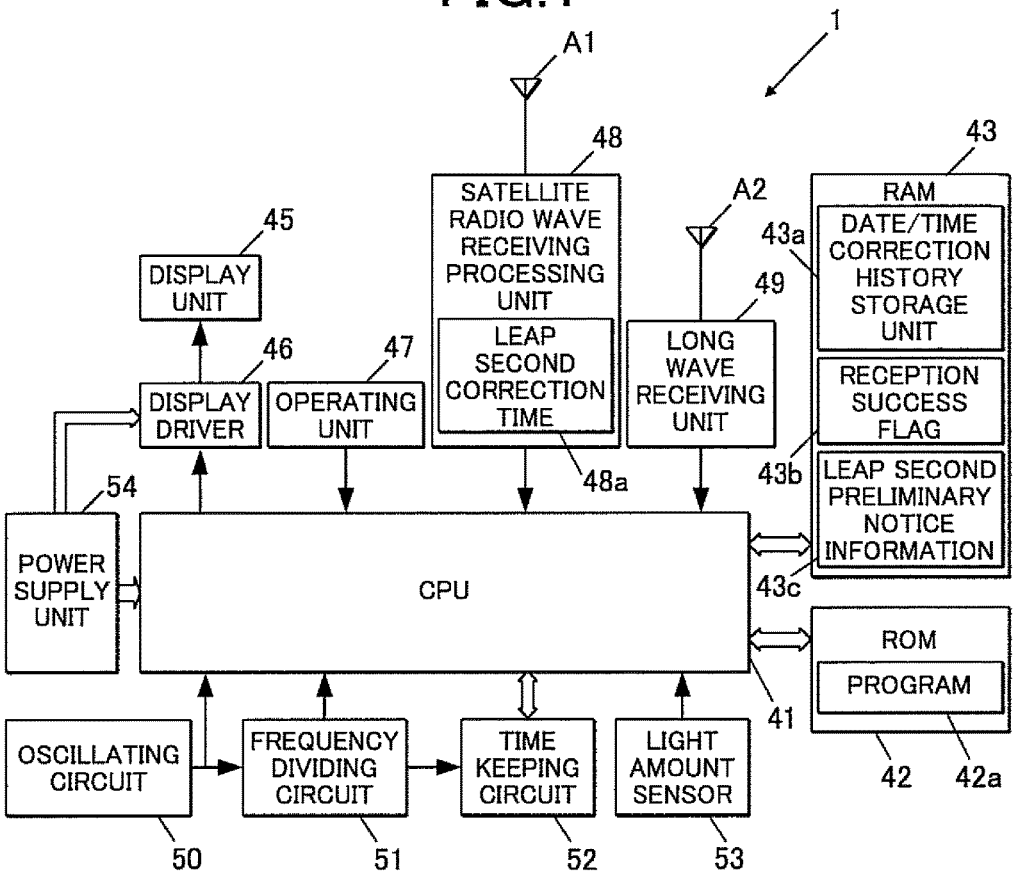
FIG. 1 is a block diagram showing a radio-controlled timepiece of an embodiment of the present invention.

FIG. 1 is a block diagram showing an internal configuration of a radio-controlled timepiece of the first embodiment of the present invention.

The radio-controlled timepiece 1 of the first embodiment is a portable electronic timepiece which is used with low electric power consumption, and an example of such radio-controlled timepiece 1 includes an electronic watch.

The radio-controlled timepiece 1 includes a CPU (Central Processing Unit) 41 (date/time obtaining necessity setting unit), a ROM (Read Only Memory) 42, a RAM (Random Access Memory) 43, a display unit 45 and a display driver 46, an operating unit 47, an oscillating circuit 50, a frequency dividing circuit 51, a timekeeping circuit 52 as a timekeeping unit, a satellite radio wave receiving processing unit 48 and antenna A1, a long wave receiving unit 49 and antenna A2, a light amount sensor 53, and a power supply unit 54.

The CPU 41 performs various calculating processing and centrally controls the entire operation of the radio-controlled timepiece 1. Moreover, the CPU 41 transmits a signal to the timekeeping circuit 52 based on the date/time data obtained from the satellite radio wave receiving processing unit 48 and the date/time data obtained by decoding the signal input from the long wave receiving unit 49. Then, the CPU 41 corrects the date/time data held by the timekeeping circuit 52. Moreover, when schedule information of start and end of summer time or preliminary notice information of executing the insert or delete of the leap second (leap second adjustment) is stored in the RAM 43, the CPU 41 corrects the date and time output from the timekeeping circuit 52 from the timing that the above events are scheduled until the accurate date/time data is obtained after the above timing by receiving the standard radio wave, etc., and outputs the corrected date and time to each unit such as the display driver 46.

The ROM 42 stores various programs for various operation performed by the radio-controlled timepiece 1 and default setting data. The program stored in the ROM 42 includes a program 42*a* used in managing the date and time counted by the timekeeping circuit 52 at the timing when the leap second can be inserted or deleted.

The RAM 43 provides a memory space for a job in the CPU 41 and stores various pieces of temporary data and rewritable setting data. The RAM 43 includes a date/time correction history storage unit 43*a*, a reception success flag 43*b* and leap second preliminary notice information 43*c*.

The date/time correction history storage unit 43*a* stores the date and time of the previous occasion that the transmitting radio wave from the positioning satellite or the transmitting radio wave (standard radio wave) in the long waveband including the time information was received and the date and time correction was performed.

The reception success flag 43*b* is binary data shown with 1 bit. When the flag is turned on (for example, set to "1"), this shows that the date/time data is obtained by receiving the radio wave (either of the satellite radio wave or the standard radio wave is acceptable) within a predetermined amount of time, here for example, 00:00:00 of the present date until the present time. According to the radio-controlled timepiece 1 of the present embodiment, when the reception success flag 43*b* is turned on, the reception success mark is also switched on on the display unit 45, and when the reception success flag 43*b* is turned off (set to "0") the reception success mark is also switched off on the display unit 45. With this, the user is able to know whether the date and time displayed on the display unit 45 at present is based on accurate date and time obtained lately from outside.

The leap second preliminary notice information 43*c* is stored for example, with a 2 bit flag. The leap second preliminary notice information 43*c* includes whether information regarding whether the leap second will be inserted or deleted at the timing that the leap second adjustment can be executed (adjustment possible date/time) which is UTC 00:00:00 on January 1st and July 1st is obtained one month previous to the timing that the leap second adjustment can be executed (December 1st and June 1st) and thereafter, and information of whether there will be the insert or delete (preliminary notice information).

Figure 9:
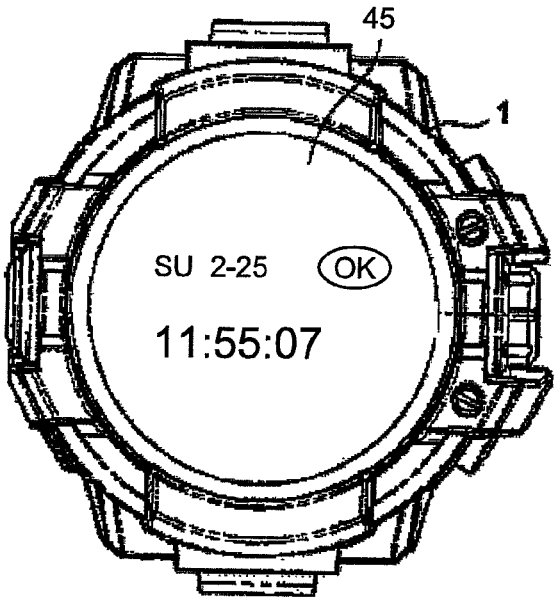
FIG. 9 shows a display unit in accordance with the invention for displaying an accuracy identification mark according to setting of the date/time obtaining necessary unit.

The display unit 45 includes a display screen and displays various information such as date/time information based on a driving signal from the display driver 46. Although the display screen is not limited, a segment type liquid crystal display (LCD) is used. As shown in FIG. 9, a display screen is able to display a reception success mark, "OK", (accuracy identification mark) showing that the date and time based on the accurate date and time obtained from the recent reception of the radio wave is counted and displayed.

The operating unit 47 includes a plurality of operation keys and press button switches, and when the operation keys and press button switches are operated, the content of operation is converted to an electric signal to be output to the CPU 41 as an input signal. Moreover, the operating unit 47 can include a winding crown or a touch sensor in addition to or instead of the operation keys and press button switches.

The satellite radio wave receiving processing unit 48 is a module which uses the antenna A1 which can receive transmitting radio waves in a L1 band (1.57542 GHz in a GPS satellite) to receive the transmitting radio wave from the GPS satellite (positioning satellite), and which demodulates a signal (navigation message) from the radio wave to decode and output date/time information and position information. According to the control signal from the CPU 41, the satellite radio wave receiving processing unit 48 turns on the power supply and operates only during receiving operation separately from the other portions. The satellite radio wave receiving processing unit 48 includes a nonvolatile memory and stores the shift amount (later described $\Delta t_{LS}$) due to the leap second in the date/time data of the GPS timepiece received from the GPS satellite as the leap second correction time 48*a*. When the date/time data of the GPS timepiece is obtained from the GPS satellite, the satellite radio wave receiving processing unit 48 calculates the present date and time corrected by referring to the leap second correction time 48*a* and outputs the above. Therefore, the satellite radio wave receiving processing unit 48 is normally able to calculate the accurate date and time by receiving only the date/time data without receiving the shift amount each time.

Moreover, when the date/time information is obtained from one GPS satellite, the satellite radio wave receiving processing unit 48 estimates the delay amount corresponding to the propagating time from the GPS satellite to the receiving location and makes a suitable correction so that the influence of delay is reduced. Then, the date/time information is output.

The satellite radio wave receiving processing unit 48 and the antenna A1 compose a first obtaining unit.

The long wave receiving unit 49 demodulates the time code signal from the standard radio wave received using the antenna A2 which receives a radio wave in the long waveband (LF wave). The standard radio wave is an amplitude modulating wave (AM wave) in the long waveband. Although not limited, for example, the long wave receiving unit 49 of the present embodiment demodulates with the superheterodyne method. The long wave receiving unit 49 is supplied with electric power from the power supply unit 54 only when the standard radio wave is received according to a control signal from the CPU 41. The tuning frequency by the antenna A2 can be changed according to the transmitting frequency of the standard radio wave transmitting station which is the receiving target by adjusting the setting of the tuning circuit which is not shown in the long wave receiving unit 49.

The long wave receiving unit 49, the antenna A2, and the CPU 41 compose a second obtaining unit.

Moreover, the CPU 41, the satellite radio wave receiving processing unit 48, the antenna A1, the long wave receiving unit 49, and the antenna A2 compose the date/time obtaining unit and the preliminary notice information obtaining unit.

The oscillating circuit 50 outputs an oscillating signal of a predetermined frequency, for example, 32 kHz. The oscillating circuit 50 is not limited and includes, for example, a crystal oscillator which is small, low in cost, low in power consumption, and does not include a temperature compensation circuit.

The frequency dividing circuit 51 divides the oscillating signal, generates the necessary frequency signal, and outputs the frequency signal. The frequency dividing circuit 51 is able to suitably switch a frequency division ratio to output a signal with a different frequency according to the control signal from the CPU 41.

Based on the predetermined frequency signal input from the frequency dividing circuit 51, the timekeeping circuit 52 keeps the present date and time by adding the set date and time obtained from the RTC (Real Time Clock). The date and time kept by the timekeeping circuit 52 is rewritten and corrected based on the data obtained from the GPS satellite and the standard radio wave with the control signal from the CPU 41.

For example, the light amount sensor 53 is provided aligned with the display screen of the display unit 45 and measures the light amount irradiated from the outside. For example, a photodiode is used as the light amount sensor 53. The light amount sensor 53 outputs an electric signal (voltage signal or current signal) according to the light amount which enters, the signal is sampled digitally in the ADC (analog/digital converter) (not shown), and the signal is input to the CPU 41.

The power supply unit 54 supplies the electric power necessary to operate each unit of the radio-controlled timepiece 1. For example, the power supply unit 54 includes a button type primary battery and the battery is provided to be removable and exchangeable. Preferably, the battery is small and lightweight and can be used stably and continuously for a long period of time consuming a small amount of electric power. Therefore, preferably, the operation of the satellite radio wave receiving processing unit 48 which consumes a drastically large amount of electric power in the radio-controlled timepiece 1 is performed within a short period of time, and sufficient intervals are open between the operations.

Next, the navigation message received from the GPS satellite is described.

Figure 2:
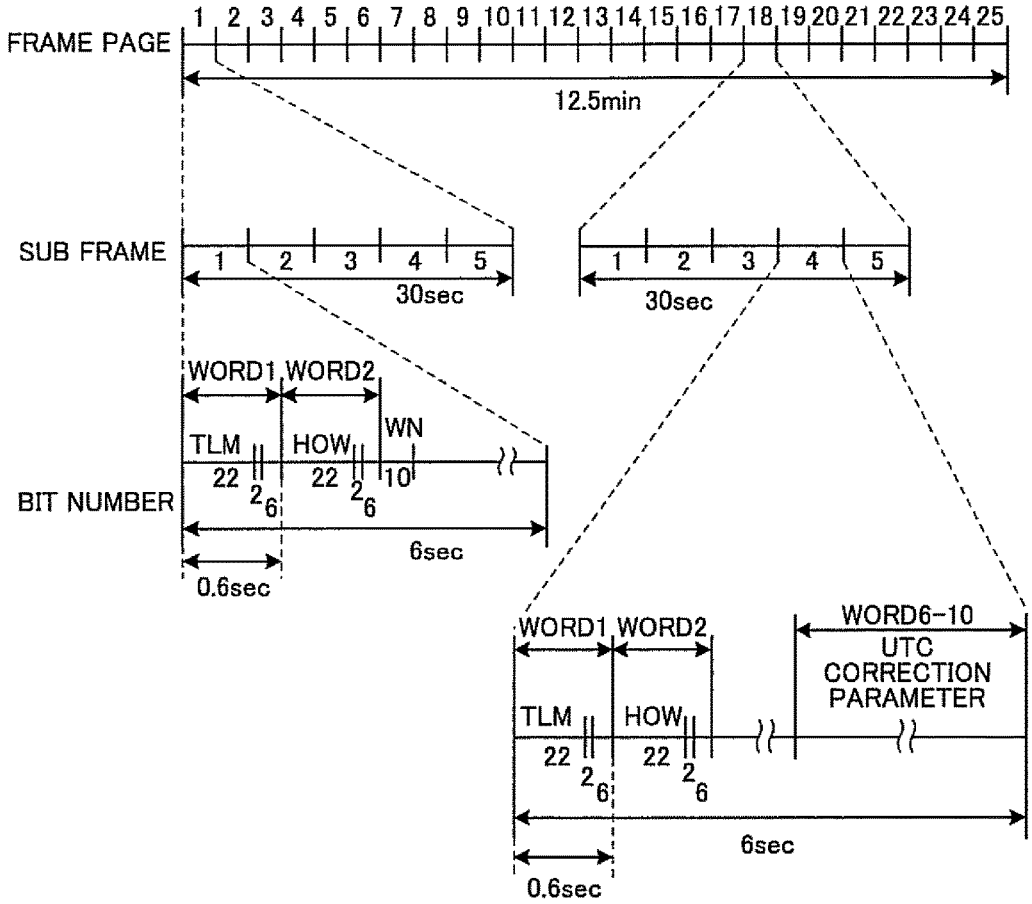
FIG. 2 is a diagram describing a format of a navigation message transmitted by the GPS satellite.

FIG. 2 is a diagram which describes the format of the navigation message transmitted by the GPS satellite.

The navigation message transmitted from the GPS satellite includes a total of 25 pages of frame data and the transmitting time of each page is 30 seconds. Each frame (page) includes 5 pieces of sub-frame data (6 seconds, 1500 bits each), and one piece of sub-frame data further includes 10 WORD (0.6 seconds, 300 bits each). Therefore, the navigation message is transmitted in an interval of 12.5 minutes.

WORD1 of all sub-frame data include TLM (telemetry word) and a lead position of the sub-frame is identified by the fixed code string (Preamble) included in the top of the TLM. WORD2 includes HOW (handover word) and a sub-frame ID. HOW shows the elapsed time within the week from 0 hours of Sunday. The sub-frame ID shows which sub-frame in the page the read data is. The Preamble of one sub-frame and the Preamble of the next sub-frame is identified to specify the position of HOW between the above and the elapsed time is identified.

In all of the pages, WORDS of the data of the sub-frame 1 includes WN (week number). The WN shows the number of the week starting from Jan. 6, 1980 counted periodically in 10 bits. In other words, by obtaining the data of 1 frame (5 sub-frames), the data of WN and HOW is reliably obtained. Here, when the difference of the date and time kept by the timekeeping circuit 52 is surely smaller than the time interval shown with HOW, in other words, one week, the present date and time can be obtained based on the HOW data and the date and time of the timekeeping circuit 52 without obtaining WN. In this case, data of any sub-frame can be received.

Therefore, in the radio-controlled timepiece 1, the data of 1 to 5 sub-frames is received as necessary and the date/time information is obtained.

In a portion of sub-frame 4 and sub-frame 5, in WORD3 and thereafter, the almanac data regarding the predicted orbit of all of the GPS satellites are sequentially transmitted divided to each page. In the data of the above sub-frames, the ID of the satellite shown in the almanac data is included in the WORD3 and the page number can be identified by the above.

A UTC correction parameter is included in the sub-frame 4 of page 18 from WORD6 to WORD10. As described above, the GPS satellite calculates the date and time of the GPS timepiece (GPS date and time) starting from Jan. 6, 1980 and the leap second is not included. Therefore, there is a difference between the GPS date and time and the UTC date and time in the amount of the integrated value of the leap second inserted by the leap second adjustment executed from Jan. 6, 1980 and thereafter. The UTC correction parameter includes the present leap second integrated value $\Delta t_{LS}$ (leap second correction time), scheduled week number $WN_{LSF}$ and day number DN when the schedule of the next leap second adjustment to be executed is determined, and a planned value $\Delta t_{LSF}$ (preliminary notice time) of the amount of the integrated value after the leap second is executed. Therefore, the satellite radio wave receiving processing unit 48 corrects the calculated GPS date and time in the amount of the integrated value $\Delta t_{LS}$ and outputs the value as the present UTC date and time. Once the UTC correction parameter is obtained, the leap second integrated value $\Delta t_{LS}$ can be continuously used until the next leap second adjustment is executed. When the adjustment with the leap second is executed, the radio-controlled timepiece 1 needs to receive a new UTC correction parameter and update the integrated value $\Delta t_{LS}$.

Next, the date/time information transmitted with the standard radio wave is described.

As the standard radio wave, there are mainly, JJY (registered trademark) of Japan, WWVB of the United States, MSF of the United Kingdom, DCF77 of Germany and the like. In such standard radio waves, the date/time information is transmitted every minute in a one minute interval from the transmitting station. The date/time information is encoded in a predetermined format for each standard radio wave, the encoded information is synchronized with the start of each second as the time code, and one code is transmitted in each second. In the radio-controlled timepiece 1, such standard radio waves are received, and the radio wave is decoded and deciphered based on the format of the time code for each transmitting station. With this, the accurate date and time in the time zone according to the transmitting station can be obtained. Various well known techniques can be applied to enhance the accuracy of deciphering when receiving, demodulating or decoding the standard radio wave. The date and time transmitted with the standard radio wave is already corrected with the leap second.

Among the above standard radio waves, the time code of the JJY includes preliminary notice information with information showing whether the leap second will be inserted or deleted. JJY is transmitted including information showing whether the leap second will be inserted, deleted, or not be inserted or deleted from one month before the timing that the leap second can be executed in 2 bits. The time code of WWVB includes preliminary notice information in 1 bit, and the information showing whether adjustment with the leap second will be executed is transmitted from one month before.

Next, the date/time information obtaining operation regarding the leap second adjustment executed in the radio-controlled timepiece 1 of the first embodiment is described.

Usually, the radio-controlled timepiece 1 obtains the date/time information at a predetermined occurrence, here, once a day. For example, when city setting is in a region where WWVB can be received, AM 00:00:10 every day in the date and time at each city is set as the first scheduled time of standard wave reception each day, and the reception of the standard radio wave is started to make an attempt to obtain the date/time information. When the obtaining of the date/time information fails, the reception of the standard radio wave is repeated at the scheduled time of standard radio wave reception set every hour from the time above until the date/time information is successfully obtained with AM 05:00:10 being the latest. When the city setting is in a region where WY can be received, WY transmits date/time information using two waves of 40 kHz and 50 kHz. For one frequency, the scheduled time of reception is set similar to WWVB, every hour from AM 00:00:10 to AM 05:00:10. For the other frequency, the scheduled time of reception is set every hour from AM 00:20:10 to AM 05:20:10. The reception is attempted alternately. In addition to reception of the above standard radio wave, when the obtaining of the date and time with the standard radio wave does not succeed by the first time each day when the light amount sensor 53 measures a light amount with a predetermined threshold level or more, the radio-controlled timepiece 1 starts reception of the transmitting radio wave from the GPS satellite, and attempts to obtain the date/time information. For example, a light amount measured when the sunlight is irradiated in the morning outside is set as the predetermined threshold level. In other words, the measurement of the light amount sensor 53 is used to judge a situation where the user is able to go outside to receive the radio wave from the GPS satellite easily.

Figure 3:
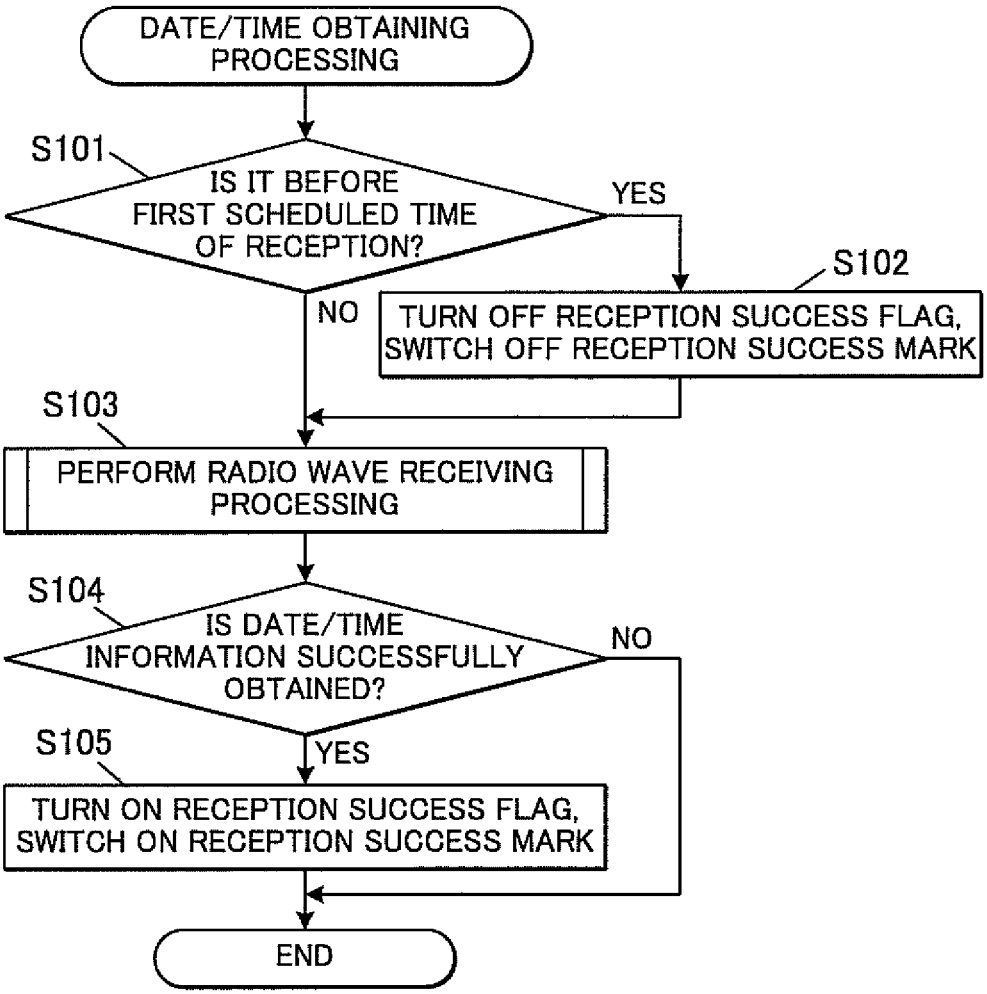
FIG. 3 is a flowchart showing control process of date/time obtaining processing.

FIG. 3 is a flowchart showing a control process performed by the CPU 41 in the date/time obtaining processing performed in the radio-controlled timepiece 1 of the present embodiment.

The date/time obtaining processing is started a predetermined amount of time before the scheduled time of standard radio wave reception (for example, 10 seconds before) and when the light amount sensor 53 measures the light amount at the threshold level or more for the first time each day.

When the date/time obtaining processing starts, the CPU 41 first judges whether the present time is before the scheduled time of standard radio wave reception for the first time that day (step S101). When it is judged that it is before the first scheduled time of standard radio wave reception ("YES", step S101), the CPU 41 sets the reception success flag 43*b* to off, and transmits the control signal to the display driver 46 to switch off the reception success mark displayed on the display unit 45 (step S102). Then, the processing by the CPU 41 advances to step S103. When it is judged that it is not before the first scheduled time of standard radio wave reception ("NO", step S101), the processing of the CPU 41 advances to step S103.

The CPU 41 calls the later-described radio wave receiving processing and receives the standard radio wave or the transmitting radio wave from the GPS satellite and attempts to obtain the date/time information (step S103). Here, the CPU 41 obtains the preliminary notice information of the leap second according to necessity.

The CPU 41 judges whether the date/time information was successfully obtained (step S104). When it is judged that the date/time information was successfully obtained ("YES", step S104), the CPU 41 sets, the reception success flag 43*b* to on, and transmits a control signal to the display driver 46 to switch on the reception success mark on the display unit 45 (step S105). Moreover, the CPU 41 stores the corrected date and time in the date/time correction history storage unit 43*a*. Then, the CPU 41 ends the date/time obtaining processing. When it is judged that the date/time information was not successfully obtained ("NO", step S104), the CPU 41 ends the date/time obtaining processing.

Figure 4:
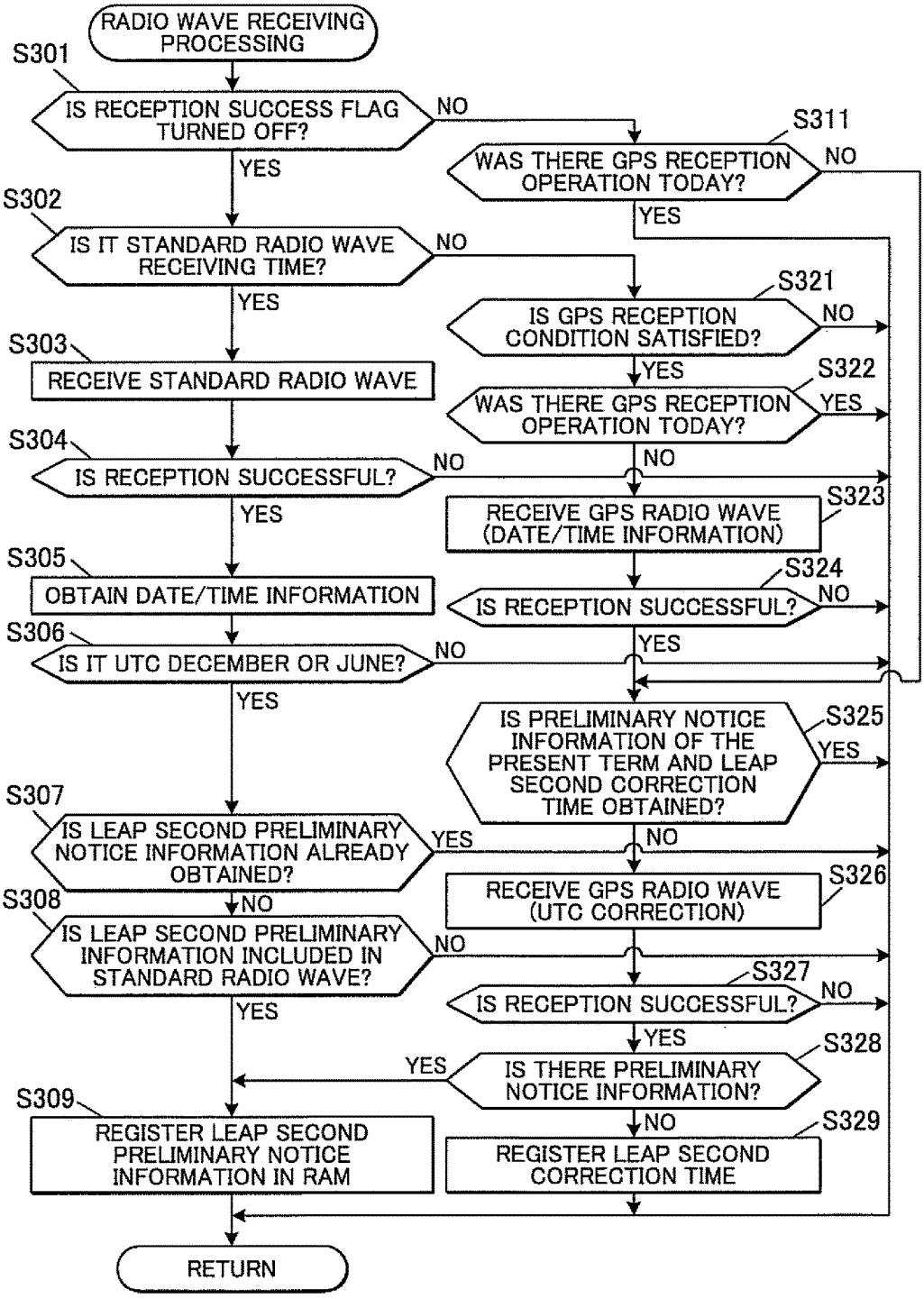
FIG. 4 is a flowchart showing control process of radio wave receiving processing.

FIG. 4 is a flowchart showing the control process performed by the CPU 41 in the radio wave receiving processing called in the processing of step S103.

When the radio wave receiving processing is called, the CPU 41 judges whether the reception success flag 43*b* is set to off (step S301). When it is judged that the flag is not set to off (set to on) ("NO", step S301), the CPU 41 judges whether the reception of the radio wave from the GPS satellite was attempted that day (whether there was operation of reception of the radio wave) (step S311). Here, whether the reception of the radio wave succeeded is not considered. When it is judged that there was an attempt to receive the radio wave from the GPS satellite that day ("YES", step S311), the CPU 41 ends the radio wave receiving processing and the processing returns to the date/time obtaining processing. When it is judged that there was no attempt to receive the radio wave ("NO", step S311), the processing of the CPU 41 advances to step S325.

When it is judged that the reception success flag 43*b* is set to off ("YES", step S301), the CPU 41 judges whether it is the scheduled time of reception of the standard radio wave in the region where the reception of the standard radio wave is possible (step S302). When it is judged that it is the scheduled time of reception of the standard radio wave or directly before (within the above described predetermined time) ("YES", step S302), the CPU 41 starts the operation of the long wave reception unit 49 according to the scheduled time of reception of the standard radio wave and the reception of the standard radio wave is performed (step S303).

The CPU 41 judges whether the reception of the standard radio wave and deciphering of the time code succeeded (step S304). When it is judged that the reception did not succeed (failed) ("NO", step S304), the CPU 41 ends the radio wave receiving processing and returns the processing to the date/time obtaining processing. When it is judged that the reception succeeded ("YES", step S304), the CPU 41 obtains the deciphered date/time information (step S305).

The CPU 41 judges whether the present date is December or June (step S306). When it is judged that it is neither ("NO", step S306), the CPU 41 ends the radio wave receiving processing and returns the processing to the date/time obtaining processing. When it is judged that it is December or June ("YES", step S306), the CPU 41 judges whether the leap second preliminary notice information 43*c* is already obtained (step S307). When it is judged that the leap second preliminary notice information 43*c* is already obtained ("YES", step S307), the CPU 41 ends the radio wave receiving processing and the processing returns to the date/time obtaining processing.

When it is judged that the leap second preliminary notice information 43*c* is not yet obtained ("NO", step S307), the CPU 41 judges whether the received standard radio wave includes the leap second preliminary notice information, in other words, whether the standard radio wave is JJY or WWVB (step S308). When it is judged that the received standard radio wave does not include the leap second preliminary notice information ("NO", step S308), the CPU 41 ends the radio wave receiving processing and the processing returns to the date/time obtaining processing.

When it is judged that the received standard radio wave includes the leap second preliminary notice information ("YES", step S308), the CPU 41 stores the information regarding the preliminary notice of the leap second deciphered in the processing in step S303 as the leap second preliminary notice information 43*c* in the RAM 43 (step S309). Then, the CPU 41 ends the radio wave receiving processing and the processing returns to the date/time obtaining processing.

In the judging processing of step S302, when it is judged that it is not the time of reception of the standard radio wave ("NO", step S302), the CPU 41 judges whether the condition to receive the radio wave from the GPS satellite is satisfied (step S321). Here, the radio wave reception condition, in other words, the light amount measured by the light amount sensor 53 being a threshold level or more for the first time that day is normally satisfied. However, when it is judged that the condition is not satisfied ("NO", step S321), the CPU 41 ends the radio wave receiving processing and the processing returns to the date/time obtaining processing.

When it is judged that the radio wave reception condition is satisfied ("YES", step S321), next, the CPU 41 judges whether the reception of the radio wave from the GPS satellite was attempted that day (step S322). When it is judged that the reception of the radio wave was already attempted by manual operation or the like ("YES", step S322), the CPU 41 ends the radio wave receiving processing and the processing returns to the date/time obtaining processing.

When it is judged that the reception of the radio wave from the GPS satellite was not attempted ("NO", step S322), the CPU 41 operates the satellite radio wave receiving processing unit 48 at a suitable timing, receives the radio wave from the GPS satellite and makes an attempt to obtain the date/time information (step S323). The CPU 41 judges whether the satellite radio wave receiving processing unit 48 successfully received the radio wave from the GPS satellite, and the date/time information was input correctly from the satellite radio wave receiving processing unit 48 to the CPU 41 (step S324). When it is judged that the radio wave was not successfully received ("NO", step S324), the CPU 41 ends the radio wave receiving processing and the processing returns to the date/time obtaining processing.

When it is judged that the date/time information was correctly input ("YES", step S324), the CPU 41 judges whether the leap second preliminary notice information of the present term or the leap second correction time is obtained (step S325). When it is judged that the leap second preliminary notice information of the present term is obtained in December or June or the leap second integrated value $\Delta t_{LS}$ which is to be the leap second correction time is obtained in January to May or July to November ("YES", step S325), the CPU 41 ends the radio wave receiving processing and the processing returns to the date/time obtaining processing.

When it is judged that the leap second preliminary notice information of the present term and the leap second correction time is not obtained ("NO", step S325), the CPU 41 advances the processing to step S326. The CPU 41 calculates the transmitting timing of the UTC correction parameter from the GPS satellite based on the obtained date/time information, and operates the satellite radio wave receiving processing unit 48 at the transmitting timing to receive the UTC correction parameter (step S326). The CPU 41 judges whether the reception of the UTC correction parameter succeeded and the information of the leap second adjustment was correctly input from the satellite radio wave receiving processing unit 48 to the CPU 41 (step S327). When it is judged that the reception did not succeed ("NO", step S327), the CPU 41 ends the radio wave receiving processing and the processing returns to the date/time obtaining processing. When it is judged that the reception succeeded ("YES", step S327), the CPU 41 judges whether the received information is preliminary notice information of leap second adjustment, in other words, whether the information is obtained in December or June (step S328). When it is judged that the information is preliminary notice information ("YES", step S328), the CPU 41 advances the processing to step S309 and the obtained information regarding the leap second adjustment is registered and stored in the RAM 43 as the leap second preliminary notice information 43*c* (step S309). Here, the CPU 41 is able to store in the RAM 43 data to temporarily correct the date/time data output from the timekeeping circuit 52 after executing leap second adjustment. Then, the CPU 41 ends the radio wave receiving processing and the processing returns to the date/time obtaining processing.

When it is judged that the received UTC correction parameter is not preliminary notice information, in other words, the information is obtained in January to May or July to November ("NO", step S328), the CPU 41 stores the obtained leap second integrated value $\Delta t_{LS}$ as the leap second correction time 48*a* in the satellite radio wave receiving processing unit 48 (step S329). Then, the CPU 41 ends the radio wave receiving processing, and the processing returns to the date/time obtaining processing.

Figure 5:
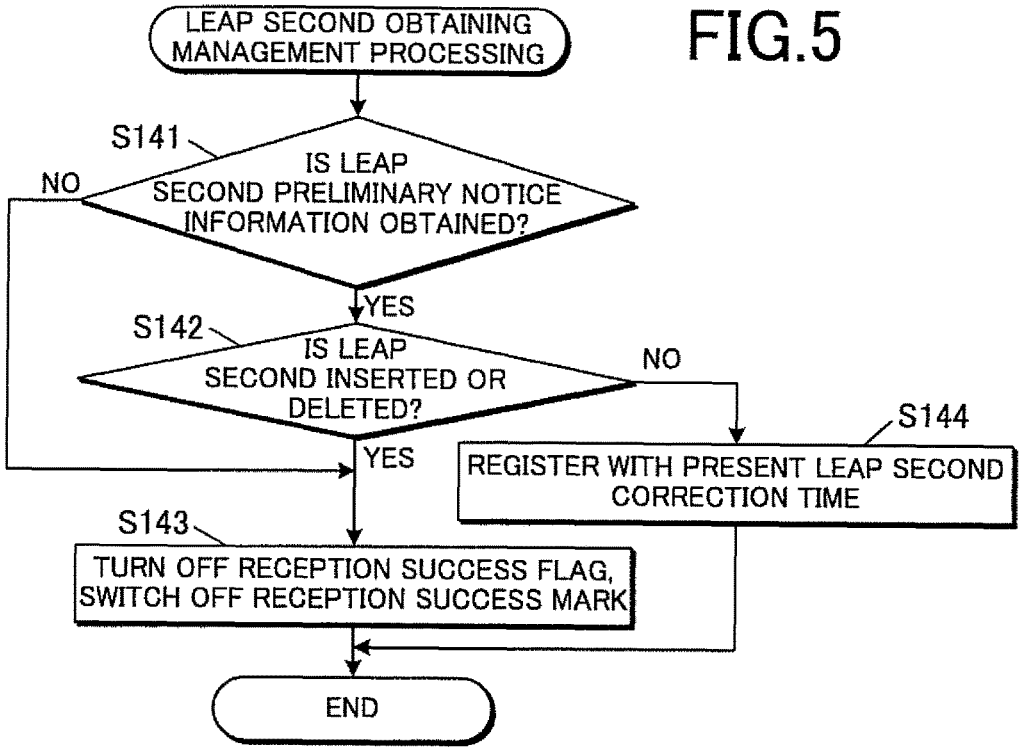
FIG. 5 is a flowchart showing control process of leap second obtaining management processing.

FIG. 5 is a flowchart showing control process performed by the CPU 41 in the leap second obtaining management processing.

The leap second obtaining management processing is called at the timing that the leap second adjustment can be performed, in other words, at or 1 second before 00:00:00 of January 1st or July 1st in UTC and executed.

When the leap second obtaining management processing starts, the CPU 41 judges whether the leap second preliminary notice information is already obtained (step S141). When it is judged that the information is not obtained ("NO", step S141), the processing of the CPU 41 advances to step S143.

When it is judged that the leap second preliminary notice information is obtained ("YES", step S141), the CPU 41 judges whether the leap second adjustment was performed this time at the timing that the leap second adjustment can be executed, in other words, whether the leap second was inserted or deleted (step S142). When it is judged that the leap second adjustment was executed ("YES", step S142), the processing of the CPU 41 advances to step S143. When it is judged that the leap second adjustment was not executed ("NO", step S142), the CPU 41 maintains the present leap second correction time 48*a* (step S144), and the CPU 41 ends the leap second obtaining management processing.

When the processing advances from either step S141 or step S142 to step S143, the CPU 41 sets the reception success flag 43*b* to off and does not display the reception success mark on the display unit 45 (step S143). Then, the CPU 41 ends the leap second obtaining management processing.

Before the leap second obtaining management processing ends, the CPU 41 is able to reset the leap second preliminary notice information 43*c*.

Figure 6:
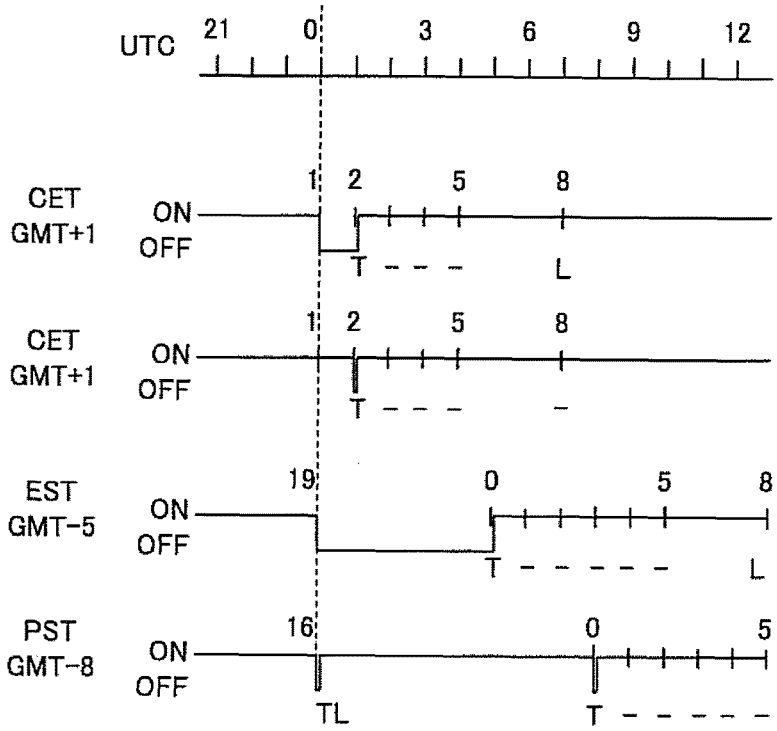
FIG. 6 is a table showing an example of leap second management status in a radio-controlled timepiece.

FIG. 6 is a table showing an example of a leap second management status in the radio-controlled timepiece 1 of the present embodiment.

Here, the horizontal lines representing on and off shown in 4 stages each shows the change of on and off of the reception success flag 43*b*. The depression of the vertical line shows the scheduled time of receiving the standard radio wave and the timing that the light amount sensor 53 detects the light amount is a threshold level or more for the first time that day. Moreover, the vertical dotted line at 0 hours UTC shows the timing that the leap second can be executed.

In a city belonging to a time zone in central Europe time (CET) which is GMT (Greenwich Mean Time)+1, in other words UTC+1, each hour from AM 02:00:10 to AM 05:00:10 is set as the scheduled time of receiving the standard radio wave in the radio-controlled timepiece 1, although the setting is not limited to the above. In this case, as shown in the top stage of FIG. 6, the leap second is inserted at AM 00:59:60 and the reception success flag 43*b* is turned off. An hour later at AM 02:00:10, the normal scheduled time of receiving the standard radio wave (MSF or DCF77) comes, the standard radio wave is received, and the date and time is corrected (T). With this, the reception success flag 43*b* is turned on again, and the reception success mark is displayed on the display unit 45. Therefore, the standard radio wave is not received from AM 03:00:10 and thereafter (–).

Since July 1st is during summer time, the time is different 1 hour from the time of CET. Therefore, the leap second adjustment is executed at AM 01:59:60 and the reception success flag 43*b* is turned off. Directly after the above, the standard radio wave is received from AM 02:00:10 to correct the date and time, and the reception success flag 43*b* is turned on again.

Further, the satellite radio wave receiving processing unit 48 operates (L) after sunrise, for example, when the light amount sensor 53 measures a light amount at a threshold or more for the first time that day at 8 AM. Here, the reception success flag 43*b* is already turned on, so the satellite radio wave receiving processing unit 48 needs to obtain only the UTC correction parameter. With the leap second integrated value $\Delta t_{LS}$ obtained from the UTC correction parameter, the leap second correction time 48*a* is registered and stored in the satellite radio wave receiving processing unit 48.

As shown in the second stage from the top in FIG. 6, when the leap second adjustment is not executed, the reception success flag 43*b* is not turned off at 1 AM, and as usual, the reception success flag 43*b* is turned off at AM 02:00:00 on the same day in the date/time obtaining processing. Then, the radio wave reception is performed at AM 02:00:10 (T). After sunrise (here, 8 AM), the satellite radio wave receiving processing unit 48 does not receive the UTC correction parameter (–).

Similarly, the scheduled time for receiving the standard radio wave is set at every hour from AM 00:00:10 to AM 05:00:10 in the radio-controlled timepiece 1 in a city on the east coast of the United States belonging to the Eastern Standard Time Zone (EST) which is GMT-5. As shown in the third stage from the top in FIG. 6, leap second adjustment is executed at 7 PM on December 31st (During summer time, 8 PM on June 30th) and the reception success flag 43*b* is turned off. Then, at AM 00:00:10 (or, during summer time, AM 01:00:10), the standard radio wave (WWVB) is received with the date/time obtaining processing, the accurate date and time after leap second adjustment is obtained, and the reception success flag 43*b* is turned on (T). Moreover, after sunrise (8 AM), the satellite radio wave receiving processing unit 48 operates and the UTC correction parameter is received and obtained (L).

Although not limited, the scheduled time for receiving the standard radio wave is set at every hour from AM 00:00:10 to AM 05:00:10 in the radio-controlled timepiece 1 in a city on the west coast of the United States belonging to the Pacific Standard Time Zone (PST) which is GMT-8. As shown in the bottom stage of FIG. 6, when the leap second adjustment is executed at 4 PM on December 31st, the reception success flag 43*b* is turned off. At this point, since it is still before sunset in regions such as southern California, the light amount sensor 53 measures the light amount being at a threshold level or more and first the satellite radio wave receiving processing unit 48 is operated. Then, the date/time information and the UTC correction parameter are received and obtained successively, the date and time of the timekeeping circuit 52 and the leap second correction time 48*a* of the satellite radio wave receiving processing unit 48 are updated, and the reception success flag 43*b* is turned on (TL).

Later on, the reception success flag 43*b* is turned off in the date/time obtaining processing as normal at AM 00:00:00 the next day, the standard radio wave (WWVB) is received from AM 00:00:10, and date/time correction is executed. Then, the reception success flag 43*b* is turned on (T).

As described above, the radio-controlled timepiece 1 of the first embodiment includes the timekeeping circuit 52, and the satellite radio wave receiving processing unit 48 and the antenna A1 and the long wave receiving unit 49 and the antenna A2 to obtain date/time information from outside. The radio-controlled timepiece 1 obtains date/time information output from the satellite radio wave receiving processing unit 48 or obtains date/time information by deciphering the signal output from the long wave receiving unit 49, and corrects the date and time kept by the timekeeping circuit 52 based on the obtained date/time information. Based on the UTC correction parameter transmitted from the GPS satellite and the leap second preliminary notice bit information transmitted in the JJY or WWVB among standard radio waves, the radio-controlled timepiece 1 obtains preliminary notice information from one month before January 1st 0 AM and July 1st 0 AM in UTC which is set as the timing that leap second adjustment can be executed. Then, when the preliminary notice information is not obtained before the timing that the leap second adjustment can be performed or the preliminary notice information is obtained and it is confirmed that the leap second adjustment is executed, the CPU 41 of the radio-controlled timepiece 1 turns off the reception success flag 43*b* at the timing that the leap second adjustment can be executed to set that the date/time information needs to be obtained. When the preliminary notice information is obtained and it is confirmed that the leap second adjustment will not be executed, the CPU 41 of the radio-controlled timepiece 1 does not change the setting of the reception success flag 43*b* at the timing that the leap second adjustment can be executed. Here, the timing that the leap second adjustment can be executed includes a slight difference in timing due to processing by the CPU 41.

In other words, when the leap second adjustment is not executed, troublesome processing such as repeatedly receiving unnecessary date/time information and confirming and adjusting are omitted. Therefore, it is possible to suppress electric power consumption while suitably performing confirmation of the date and time regarding the insert or delete of the leap second only when necessary. Therefore, the timekeeping circuit 52 is able to count accurate date/time data.

Moreover, since the radio-controlled timepiece 1 includes the satellite radio wave receiving processing unit 48 and the antenna A1, it is possible to obtain the date/time information by receiving the transmitting radio wave from the GPS satellite. Therefore, at the timing when the leap second is executed, in addition to HOW normally received to obtain the date/time information, the UTC correction parameter needs to be received to obtain the leap second integrated value $\Delta t_{LS}$. Therefore, the radio-controlled timepiece 1 is set showing that the UTC correction parameter needs to be received from the GPS satellite, and the operation of receiving the UTC correction parameter is performed rapidly at the timing that the transmitting radio wave can be received from the GPS satellite.

With this, the radio-controlled timepiece 1 is able to confirm that the transmitting date and time is obtained from the GPS satellite reliably and accurately, and the timekeeping circuit 52 is able to keep the accurate date and time.

The display unit 45 displays the reception success mark linked with the reception success flag 43*b* together with the date and time. Therefore, when the leap second adjustment is not executed, the reception success mark which was conventionally always switched off from UTC January 1st 0 hours and July 1st 0 hours and after until the date/time information is received again is not switched off. Consequently, the radio-controlled timepiece 1 does not perform unnecessary notification to the user regarding a decrease in accuracy of the displayed date and time.

Second Embodiment

Next, the radio-controlled timepiece 1 of the second embodiment is described.

The internal configuration of the radio-controlled timepiece 1 of the second embodiment is the same as the radio-controlled timepiece 1 of the first embodiment. Therefore, the same reference numerals are used and the description is omitted.

Next, the date/time obtaining processing performed in the radio-controlled timepiece 1 of the second embodiment is described.

Figure 7:
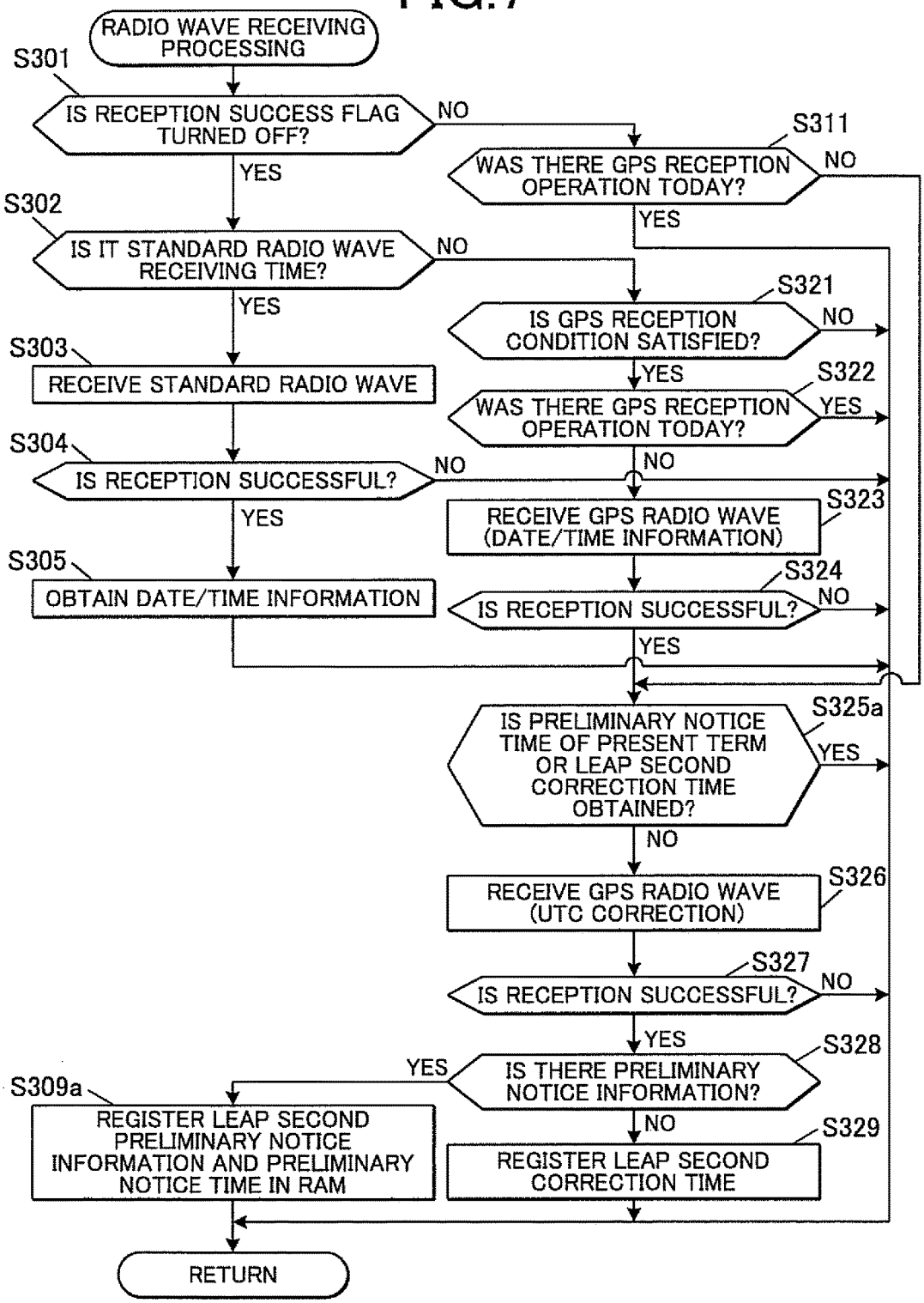
FIG. 7 is a flowchart showing control process of radio wave receiving processing in a radio-controlled timepiece of the second embodiment.

FIG. 7 is a flowchart showing the control process by the CPU 41 in the radio wave receiving processing called in the date/time obtaining processing in the radio-controlled timepiece 1 of the second embodiment.

The date/time obtaining processing of the present embodiment is the same as the date/time obtaining processing of the first embodiment shown in FIG. 3 with the exception of calling the radio wave receiving processing shown in FIG. 7 in the processing of step S103. Therefore, the description is omitted. The radio wave receiving processing of the present embodiment as shown in FIG. 7 is the same as the radio wave receiving processing of the first embodiment with the exception of the following points, (i) the processing of steps S306 to S308 are omitted, and when the processing of step S305 ends, the radio wave receiving processing ends, and (ii) the processing of steps S309 and S325 is replaced with steps S309*a* and S325*a*. Therefore, the same reference numerals are applied to the same processing and the detailed description is omitted.

In other words, in the radio wave receiving processing of the present embodiment, the preliminary notice information regarding the leap second adjustment is not obtained from the standard radio wave. Moreover, when the processing advances from the determining processing of step S328 to the processing of step S309*a*, the CPU 41 stores in the RAM 43 not only whether the leap second adjustment is executed but also the scheduled time of the leap second correction time changed after the leap second adjustment is executed as the leap second preliminary notice information 43*a*.

Moreover, when the processing advances from step S311 or step S324 to step S325*a*, the CPU 41 judges whether the preliminary notice time of the present term or the leap second correction time is obtained (step S325*a*). In other words, when the preliminary notice time is obtained in the processing of step S309*a*, the determining result of this processing is "YES" even after the timing that the leap second adjustment can be executed.

Figure 8:
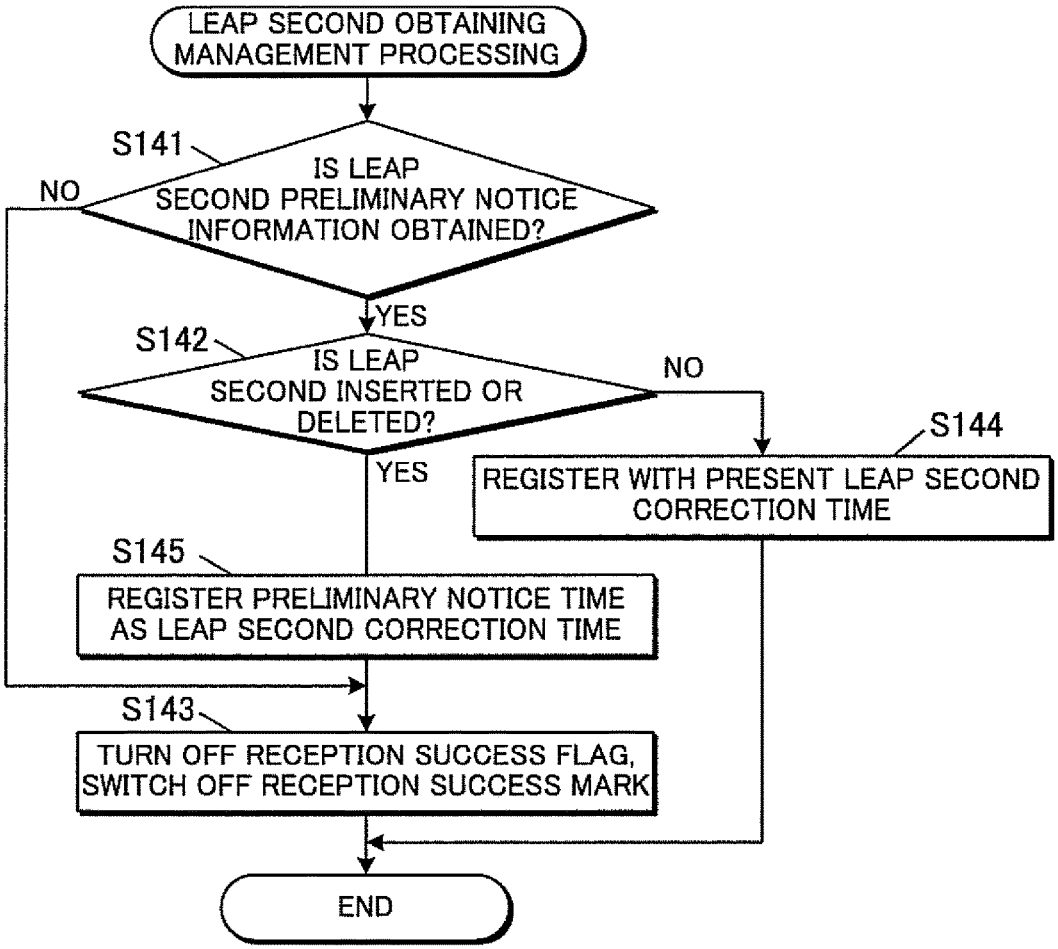
FIG. 8 is a flowchart showing control process of leap second obtaining management processing in the radio-controlled timepiece of the second embodiment.

FIG. 8 is a flowchart showing control process by the CPU 41 in the leap second obtaining management processing performed in the radio-controlled timepiece 1 of the second embodiment.

The leap second obtaining management processing is the same as the leap second obtaining management processing in the radio-controlled timepiece 1 of the first embodiment with the exception of adding the processing of step S145. Therefore, the same reference numerals are applied to the same processing and the description is omitted.

In the determining processing of step S142, when it is judged that the leap second is inserted or deleted ("YES", step S142), the CPU 41 registers the preliminary notice time stored in the RAM 43 as the leap second preliminary notice information 43*c* as the leap second correction time 48*a* (step S145). Then, the CPU 41 advances the processing to step S143.

In other words, in the radio-controlled timepiece 1, when the UTC correction parameter is received before the leap second adjustment is executed, and the preliminary notice time is registered as the leap second preliminary notice information 43*c*, after the leap second adjustment, the preliminary notice time is used as is as the leap second correction time 48*a* and the UTC correction parameter is not received again after the leap second adjustment.

As described above, according to the radio-controlled timepiece 1 of the second embodiment, the UTC correction parameter can be obtained as the leap second preliminary notice information from the GPS satellite. Therefore, when the UTC correction parameter is obtained before the timing that the leap second adjustment is executed, by setting the preliminary notice time $\Delta t_{LS}$ with the leap second integrated value $\Delta t_{LS}$, the leap second information after the leap second adjustment can be determined while suppressing the trouble of reception again and the consumption of electric power. Therefore, the radio-controlled timepiece 1 can be set so that the UTC correction parameter is obtained only when the UTC correction parameter is not obtained before the leap second adjustment is executed.

When the UTC correction parameter is obtained as the leap second preliminary notice information and it is confirmed that the leap second adjustment is executed, after the leap second adjustment is executed, the radio-controlled timepiece 1 is set showing that it is necessary to obtain the date and time after the leap second adjustment from the standard radio wave, GLONASS or the like. With this, it is possible to easily confirm whether the date and time counted by the timekeeping circuit 52 matches the date and time reflecting the leap second adjustment by simple operation regarding obtaining the date and time as normal.

In the above example, the date and time after the leap second adjustment is obtained from the standard radio wave. Therefore, the electric power consumption can be largely reduced compared to when the transmitting radio wave is received from the positioning satellite.

The preliminary notice information regarding the leap second adjustment is not obtained uniformly from the standard radio wave transmitting station. Therefore, the date/time obtaining processing does not become complicated due to the standard radio wave transmitting stations having differences in whether there is information of the leap second and the information amount.

The present invention is not limited to the above described embodiments and various changes are possible.

For example, in the above described embodiments, reception of the radio wave from the GPS satellite is described. However, radio waves from positioning satellites which transmit or are planned to transmit radio waves in a format corresponding to the GPS satellite such as positioning satellites of Quasi-Zenith Satellite System of Japan can be treated similar to the radio wave from the GPS satellite. The transmitting radio waves of such positioning satellites can be received, the preliminary notice information of the leap second adjustment can be obtained and the leap second correction time can be obtained as necessary.

The positioning satellite of other positioning systems such as GLONASS transmit the date and time reflecting the leap second similar to the standard radio wave. Therefore, the radio waves from such positioning satellites can be received after the timing that the leap second adjustment can be executed to obtain the accurate date and time. Especially outside the regions where the standard radio wave can be received, by receiving the radio waves from such positioning satellites to obtain the date and time after the leap second adjustment is executed, it is possible to match the date and time of the timekeeping circuit 52 to the accurate date and time reflecting the leap second adjustment.

The present invention can be applied when the leap second preliminary notice information and the date and time after the leap second adjustment is executed is obtained only by the standard radio wave such as JJY or WWVG. In this case, control of reception of the transmitting radio wave from the GPS satellite, specifically, management regarding obtaining the leap second correction time 48*a* from the UTC correction data is not necessary.

As in cities on the west coast of the United States belonging to the Pacific Standard Time Zone which is GMT-8 shown in FIG. 6, when the leap second adjustment is executed and the reception success flag 43*b* is simply turned off, in areas such as east Asia, Oceania to the west coast of North America, the condition to receive the radio wave from the GPS satellite may be satisfied before the receiving timing of the standard radio wave. In such case also, as shown in the second embodiment, when the leap second preliminary notice information is obtained from the GPS satellite and the UTC correction parameter is not received again after the leap second adjustment is executed, there is no need to receive the radio wave from the GPS satellite again. Therefore, when the reception success flag 43*b* is off, it is possible to apply a limit so that the radio wave is not received from the GPS satellite. Then, only the standard radio wave or the radio wave of other positioning satellites such as GLONASS can be received to only confirm that the leap second adjustment was executed.

According to the above described embodiments, when the UTC correction parameter is received when the reception success flag 43*b* is off, the sub-frame data including the UTC correction parameter is directly received in the processing of step S326. However, the conventional process can be performed, and data of any sub-frame or frame can be received to calculate the transmitting timing of the UTC correction parameter relatively with respect to the receiving timing and then the UTC correction parameter can be received.

According to the description of the above embodiments, various processing is performed using the preliminary notice information of the leap second adjustment and the date/time information obtained when the operation regarding the date/time correction is automatically performed in the radio-controlled timepiece 1. However, when the date and time is obtained by manual operation by the user, or the positioning is performed using the GPS satellite, the preliminary notice information and the date/time information obtained by the above can also be used.

According to the above described embodiments, the reception success flag 43*b* is turned off every day and the date/time information is obtained. However, this interval can be suitably changed according to the accuracy of the date and time kept by the timekeeping circuit 52. According to the above-described embodiments, even if the reception success flag 43*b* is turned off in the leap second obtaining management processing, the standard radio wave is received only at the scheduled time of receiving the standard radio wave when the normal date/time obtaining processing is started. However, the timing of receiving the standard radio wave after the leap second adjustment is executed or when the preliminary notice information is not obtained can be suitably adjusted by adding or advancing the receiving timing. In this case, the receiving operation may be performed at a time different from the normal scheduled time of reception. Therefore, another sensor such as an acceleration sensor can judge the moving state to determine whether the reception of the standard radio wave is difficult. When the leap second adjustment is not executed, even if the reception success flag 43*b* is off from before the timing that the leap second adjustment can be executed, the adjustment of the receiving timing of the standard radio wave after the timing of executing the leap second adjustment is not necessary.

According to the above-described embodiments, the satellite radio wave receiving processing unit 48 stores the leap second correction time 48*a* in a nonvolatile memory or the like. However, the leap second correction time 48*a* can be stored in the RAM 43, and the data can be input in the satellite radio wave receiving processing unit 48 when the receiving processing is performed by the satellite radio wave receiving processing unit 48, and the present date and time can be calculated.

According to the above described embodiments, the date/time information is obtained with the standard radio wave, however, other methods such as date/time information transmitted from the base station of a cellular telephone can be used instead or used together. When used together, for example, after "NO" in the judging processing of step S321 in FIG. 4, further control of obtaining processing of the date and time by the added date/time obtaining method is performed. The preliminary notice information regarding whether the leap second adjustment is executed is not limited to the standard radio wave or the transmitting radio wave from the GPS satellite and other methods can be employed such as obtaining directly or through external devices connected to the radio-controlled timepiece 1 the information obtained through the Internet.

According to the second embodiment, both of the following are not performed, the preliminary notice information from the standard radio wave is not obtained and the leap second correction time obtained when the leap second preliminary notice information is obtained from the GPS satellite is not obtained again. However, the radio-controlled timepiece 1 can be configured so that only one of the above is not performed.

The specific details of the above described embodiments such as configuration, control process, condition, numeric value and the like can be suitably changed without leaving the scope of the present invention.

Although various exemplary embodiments have been shown and described, the invention is not limited to the embodiments shown. Therefore, the scope of the invention is intended to be limited solely by the scope of the claims that follow and its equivalents.

The entire disclosure of Japanese Patent Application No. 2014-004043 filed on Jan. 14, 2014 including specification, claims, drawings and abstract are incorporated herein by reference in its entirety.

What is claimed is:

1. A radio-controlled timepiece comprising:

a timekeeping unit which keeps date and time;

a date/time obtaining unit which obtains date/time information from outside to correct the date and time of the timekeeping unit;

a preliminary notice information obtaining unit which obtains from outside preliminary notice information regarding whether leap second adjustment in which a leap second is inserted or deleted is executed;

a date/time obtaining necessity setting unit which sets whether the date/time information needs to be obtained by the date/time obtaining unit based on history of obtaining the date/time information by the date/time obtaining unit;

a reception success flag setting storage unit which stores setting of on or off of a reception success flag showing that the date/time information is obtained by the date/time obtaining unit within a predetermined amount of time; and a display unit which is able to display the date and time kept by the timekeeping unit and an accuracy identification mark according to setting of the date/time obtaining necessity setting unit, wherein the date/time obtaining necessity setting unit, (i) sets the reception success flag to off to show that the date/time information needs to be obtained at a timing of adjustment possible date/time which is determined to be date and time when the leap second adjustment can be executed, when the preliminary notice information is not obtained by the adjustment possible date/time or the preliminary notice information is obtained and it is confirmed that the leap second adjustment is executed at the adjustment possible date/time, and (ii) does not set the reception success flag to off at the adjustment possible date/time when the preliminary notice information is obtained and the leap second adjustment is not executed, and wherein the accuracy identification mark continuously displays a status of the reception success flag.

2. The radio-controlled timepiece of claim 1, wherein the date/time obtaining unit further includes a first obtaining unit which receives a transmitting radio wave from a positioning satellite and obtains date/time information; and wherein the date/time obtaining necessity setting unit sets the date/time information including UTC correction parameter transmitted from the positioning satellite needs to be obtained at the timing of the adjustment possible date/time.

3. The radio-controlled timepiece of claim 2, wherein the preliminary notice information obtaining unit is able to obtain the UTC correction parameter as the preliminary notice information;

wherein the date/time obtaining unit obtains leap second information of the adjustment possible date/time and thereafter from the UTC correction parameter when the UTC correction parameter is obtained as the preliminary notice information; and wherein the date/time obtaining necessity setting unit sets the date/time information including the UTC correction parameter needs to be obtained when the UTC correction parameter is not obtained by the preliminary notice information obtaining unit.

4. The radio-controlled timepiece of claim 3, wherein the date/time obtaining necessity setting information sets, the date and time after the leap second adjustment needs to be obtained at the timing of the adjustment possible date/time when the UTC correction parameter is obtained as the preliminary notice information and the leap second adjustment is executed.

5. The radio-controlled timepiece of claim 4, wherein the date/time obtaining unit includes a second obtaining unit which receives a transmitting radio wave of a long waveband including date/time information to obtain the date/time information; and wherein the date and time after the leap second adjustment is obtained by the second obtaining unit.

6. The radio-controlled timepiece of claim 1, wherein the date/time obtaining unit further includes:

a first obtaining unit which obtains the date/time information by receiving a transmitting radio wave from a positioning satellite; and a second obtaining unit which obtains the date/time information by receiving a transmitting radio wave in a long waveband including the date/time information, and wherein the predetermined flag shows that the date/time information is obtained by either the first obtaining unit or the second obtaining unit within the predetermined amount of time.

* * * * *